US011674683B2

(12) United States Patent
Lee

(10) Patent No.: US 11,674,683 B2
(45) Date of Patent: Jun. 13, 2023

(54) COOKTOP AND KNOB ASSEMBLY THEREOF

(71) Applicant: LG Electronics Inc., Seoul (KR)

(72) Inventor: Dae Yong Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/460,619

(22) Filed: Aug. 30, 2021

(65) Prior Publication Data

US 2022/0065438 A1 Mar. 3, 2022

(30) Foreign Application Priority Data

Aug. 28, 2020 (KR) ..... 10-2020-0109646

(51) Int. Cl.

| | |
|---|---|
| ***F21V 33/00*** | (2006.01) |
| ***F21V 3/02*** | (2006.01) |
| ***F24C 3/12*** | (2006.01) |
| ***F24C 7/08*** | (2006.01) |
| ***G05G 1/10*** | (2006.01) |

(52) U.S. Cl.

CPC ..... *F21V 33/0044* (2013.01); *F21V 3/02* (2013.01); *F24C 3/126* (2013.01); *F24C 7/082* (2013.01); *G05G 1/105* (2013.01)

(58) Field of Classification Search

CPC ..... F21V 33/004; F21V 3/02; F24C 3/126; F24C 7/082; G05G 1/105

See application file for complete search history.

(56) References Cited

U.S. PATENT DOCUMENTS 10,345,514 B2 7/2019 Kozinski et al.
10,458,656 B2 * 10/2019 Jung ..... H01H 9/18

FOREIGN PATENT DOCUMENTS

| | | | | |
|---|---|---|---|---|
| JP | 2008288188 | | 11/2008 | |
| JP | 2008288188 | A * | 11/2008 | |
| KR | 20170079067 | | 7/2017 | |
| WO | WO2012056498 | | 5/2012 | |
| WO | WO-2012056498 | A1 * | 5/2012 | ..... G05G 1/08 |

OTHER PUBLICATIONS

Extended European Search Report in European Appln. No. 21193427.8, dated Jan. 14, 2022, 8 pages.

* cited by examiner

*Primary Examiner* — Matthew J. Peerce
(74) *Attorney, Agent, or Firm* — Fish & Richardson P.C.

(57) ABSTRACT

A cooktop includes a knob assembly coupled to a control panel and configured to control a heating part. The knob assembly includes: a knob body disposed at a front surface of the control panel and rotating with respect to a rotation shaft extended in a front-rear direction, a knob ring disposed at a rear side of the knob body and having a diameter greater than a diameter of the knob body, and a light source part disposed at the rear side of the knob body and including one or more light sources irradiating light to the rear side of the knob body. A portion of a rear surface of the knob body includes a first reflective surface reflecting light, and a portion of a surface of the knob ring includes a second reflective surface reflecting light, the portion of the surface of the knob ring facing the knob body.

15 Claims, 12 Drawing Sheets

COOKTOP AND KNOB ASSEMBLY THEREOF

CROSS-REFERENCE TO RELATED APPLICATION

This application claims priority to and the benefit of Korean Patent Application No. 10-2020-0109646, filed on Aug. 28, 2020, the disclosure of which is incorporated herein by reference in its entirety.

TECHNICAL FIELD

Disclosed herein are a cooktop and a knob assembly thereof, and the cooktop and the knob assembly are capable of emitting light around a knob to enhance user recognition of operation of a product.

BACKGROUND

Cooktops heat food items using gas or electricity to cook the food items. The cooktops can include a knob that rotates around a shaft to adjust an amount of heat applied to a food item or to manipulate the cooktop such as the setting of a cooking mode and the like.

Knobs (or switches), around which light is emitted to improve visibility, is disclosed in prior art document 1 (KR Patent Publication No. 2017-0079067) and prior art document 2 (U.S. Pat. No. 10,345,514) and the like.

FIGS. 1 and 2 are views showing a switch assembly in prior art document 1.

The switch assembly in document 1 can include a switch 1, a light guide 2, a switch holder 3, a control panel 4, a support bracket 5, and a regulator 6.

The light guide 2 includes a light guide path 2-1 and an LED module 2-2. The LED module 2-2 is disposed at one end of the light guide path 2-1. Since the LED module 2-2 as a light source is disposed at one end of the light guide path 2-1, constant brightness of light cannot be ensured according to document 1. That is, one end of the light guide path 2-1, at which the LED module 2-2 is disposed, is relatively bright, while the other end on the opposite side of one end is relatively dark.

FIG. 3 is a view showing a portion of a knob assembly in prior art document 2.

The knob assembly in document 2 includes a first light guide 7, a second light guide 8, and a bezel main body 9. The second light guide 8 includes a leg 8-1 extended toward a light source, and a guide ring 8-2 forming a diffused light. According to document 2, the light source is disposed in an end portion of the leg 8-1. Accordingly, a portion of the guide ring 8-2, contacting the leg 8-1, is relatively bright, while a portion far from the portion in contact with the leg 8-1 is relatively dark.

SUMMARY

Technical Problem

In one embodiment, provided are a cooktop and a knob assembly that may enhance user recognition of operation of a product.

In one embodiment, provided are a cooktop and knob assembly that may increase intensity of light emitted from a knob assembly.

In one embodiment, provided are a cooktop and a knob assembly that may improve aesthetic qualities thanks to light that has constant brightness and is emitted from around a knob body of a knob assembly.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

Technical Solution

In one embodiment, a cooktop and/or a knob assembly may include a reflective surface disposed between a knob body and a knob ring. Accordingly, irradiated light may be reflected by the reflective surface and then emitted to a gap between the knob body and the knob ring.

In one embodiment, a portion of a rear surface of the knob body of the cooktop and/or a knob assembly may reflect light.

In one embodiment, at least a portion of a front surface of the knob ring of the cooktop and/or the knob assembly may reflect light.

In one embodiment, at least a portion of the knob body of the cooktop and/or the knob assembly may form a light diffusing part configured to diffuse light.

Thus, light rays, which are not directly emitted to a front of the knob assembly among light rays irradiated from a rear of the knob body, may be emitted to the front of the knob assembly as a result of reflection.

A cooktop in one embodiment may include a heating part configured to cook a food item, and a manipulating part including a control panel and a knob assembly fixed to the control panel and configured to control the heating part, and the knob assembly may include a knob body disposed on a front surface of the control panel and configured to rotate around a rotation shaft extended in a front-rear direction, a knob ring disposed at a rear of the knob body and having a diameter greater than a diameter of the knob body, and a light source part disposed at the rear of the knob body and including at least one of light sources configured to irradiate light to the rear of the knob body, and a first reflective surface configured to reflect light may be formed in at least a portion of a rear surface of the knob body, and a second reflective surface configured to reflect light may be formed in at least a portion of a surface of the knob ring facing the knob body.

In the cooktop of one embodiment, the knob ring may include a plate formed into a flat plate, and a ring surrounding an outer edge of the plate, protruding from the plate forward, having a diameter greater than the diameter of the knob body and forming an exterior of the knob assembly, and the second reflective surface may include a 2-1 reflective surface formed in at least a portion of a front surface of the plate and a 2-2 reflective surface formed in at least a portion of an inner surface of the ring.

In the cooktop of one embodiment, at least a portion of the knob body may be inserted into a space formed by the plate and the ring.

In the cooktop of one embodiment, the knob body may include a light diffusing part configured to diffuse light.

In the cooktop of one embodiment, the knob body may include a knob forming an exterior of a front surface of the knob assembly and having a rear surface that is open to form a first inner space, a knob inner inserted into the first inner surface and having a rear surface that is open to form a second inner space, and an insert inserted into the second inner space. In this case, the first reflective surface may be formed in at least a portion of a rear surface of the insert. And/or at least a portion of the knob inner may form a light diffusing part configured to diffuse light.

In the cooktop of one embodiment, when viewed from a rear, the insert of the knob body may be disposed in a central portion of the knob inner.

In the cooktop of one embodiment, the knob ring may be provided with at least one of openings, the light source part may be disposed at a rear of the knob ring, and at least one of the light sources may be disposed at a rear of at least one of the openings.

The cooktop in one embodiment may further include a supporter disposed between the knob ring and the light source part and provided with the light source part fixed to a rear surface thereof.

In the cooktop of one embodiment, the supporter may include at least one of convex parts protruding forward from a front surface of a position corresponding to a position of the light source, and disposed in a way that the convex part passes through the opening.

A knob assembly in one embodiment may include a knob body configured to rotate around a rotation shaft extended in a front-rear direction, a knob ring disposed at a rear of the knob body, having a diameter greater than a diameter of the knob body and attached to a control panel, and a light source part disposed at the rear of the knob body and including at least one of light sources configured to irradiate light to the rear of the knob body, and a first reflective surface configured to reflect light may be formed in at least a portion of a rear surface of the knob body, and a second reflective surface configured to reflect light may be formed in at least a portion of a surface of the knob ring facing the knob body.

In the knob assembly of one embodiment, the knob ring may include a plate formed into a flat plate, and a ring surrounding an outer edge of the plate, protruding from the plate forward, having a diameter greater than the diameter of the knob body and forming an exterior of the knob assembly, and the second reflective surface may include a 2-1 reflective surface formed in at least a portion of a front surface of the plate and a 2-2 reflective surface formed in at least a portion of an inner surface of the ring.

In the knob assembly of one embodiment, at least a portion of the knob body may be inserted into a space formed by the plate and the ring.

In the knob assembly of one embodiment, the knob body may include a knob forming an exterior of a front surface of the knob assembly and having a rear surface that is open to form a first inner space, a knob inner inserted into the first inner surface and having a rear surface that is open to form a second inner space, and an insert inserted into the second inner space. In this case, the first reflective surface may be formed in at least a portion of a rear surface of the insert. And/or at least a portion of the knob inner may form a light diffusing part configured to diffuse light.

In the knob assembly of one embodiment, when viewed from a rear, the insert of the knob body may be disposed in a central portion of the knob inner.

The knob assembly in one embodiment may further include a supporter disposed between the knob ring and the light source part, provided with the light source part fixed to a rear surface thereof and including a convex part protruding forward from a front surface of a position corresponding to a position of the light source, the knob ring may be provide with at least one of openings, and the convex part may be disposed in a way that the convex part passes through the opening.

Advantageous Effect

A cooktop and/or a knob assembly in one embodiment may enhance user recognition of operation of a product, thereby improving user convenience. Specifically, in one embodiment, irradiated light may be reflected by a reflective surface formed between a knob body and a knob ring, and emitted to a gap between the knob body and the knob ring, without being locked between the knob body and the knob ring. Thus, intensity of light emitted from the knob assembly may increase, thereby enhancing user recognition of operation of a product.

Additionally, in one embodiment, light may reflect in different directions, and light having constant brightness may be emitted around the knob body, thereby improving aesthetic qualities.

Specific effects are described along with the above-described effects in the section of Detailed Description.

BRIEF DESCRIPTION OF DRAWING

The accompanying drawings constitute a part of the specification, illustrate one or more embodiments in the disclosure, and together with the specification, explain the disclosure, wherein.

DETAILED DESCRIPTION

Figure 1:
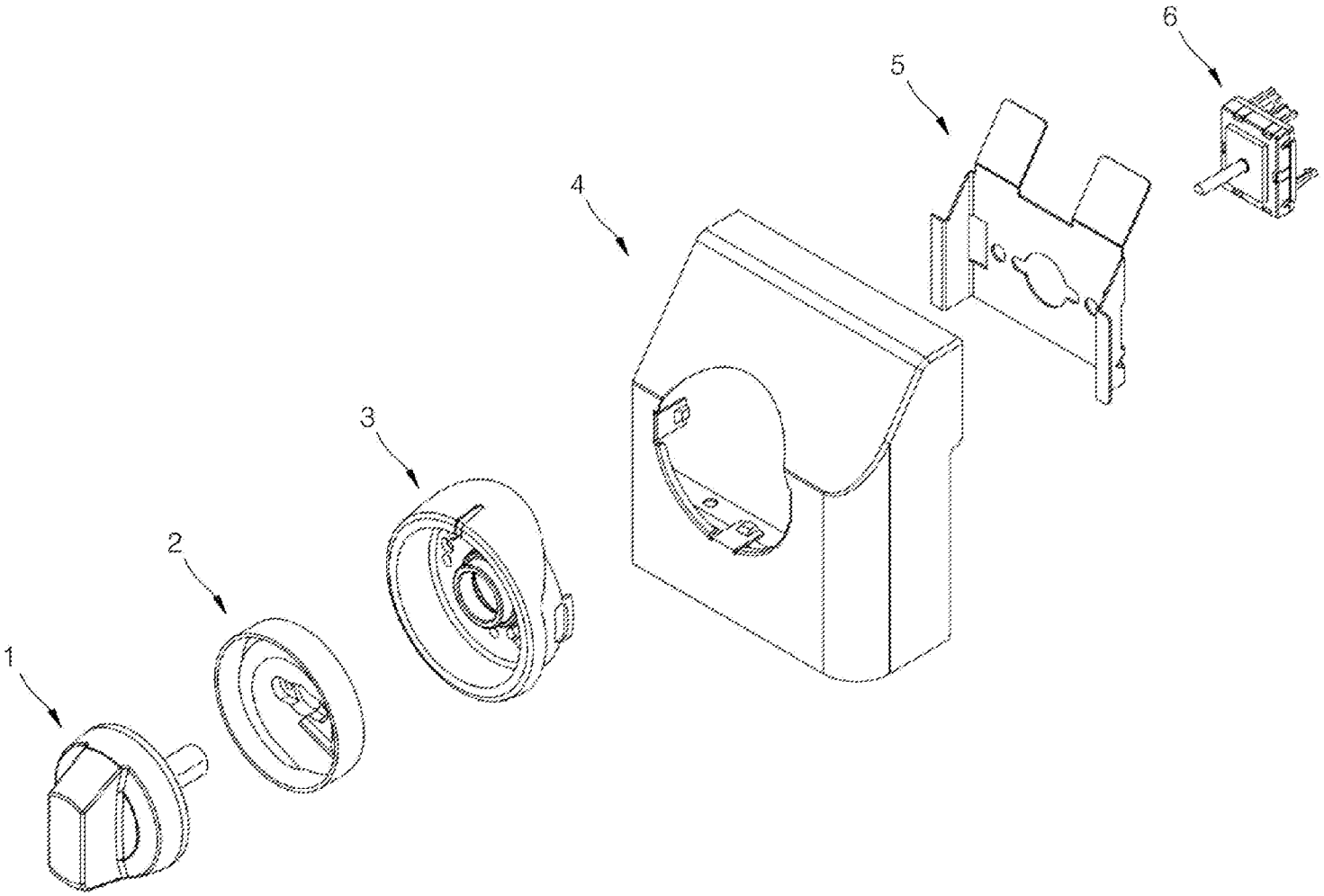
FIG. 1 Prior Art
FIGS. 1 and 2 are views showing a switch assembly in prior art document 1.
Figure 2:
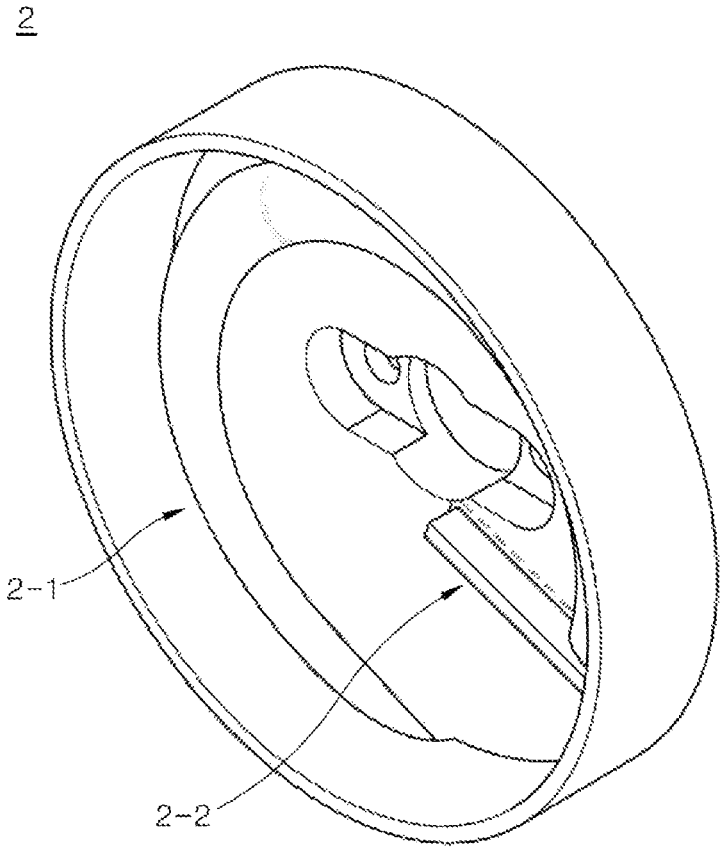
FIG. 2 Prior Art
Figure 3:
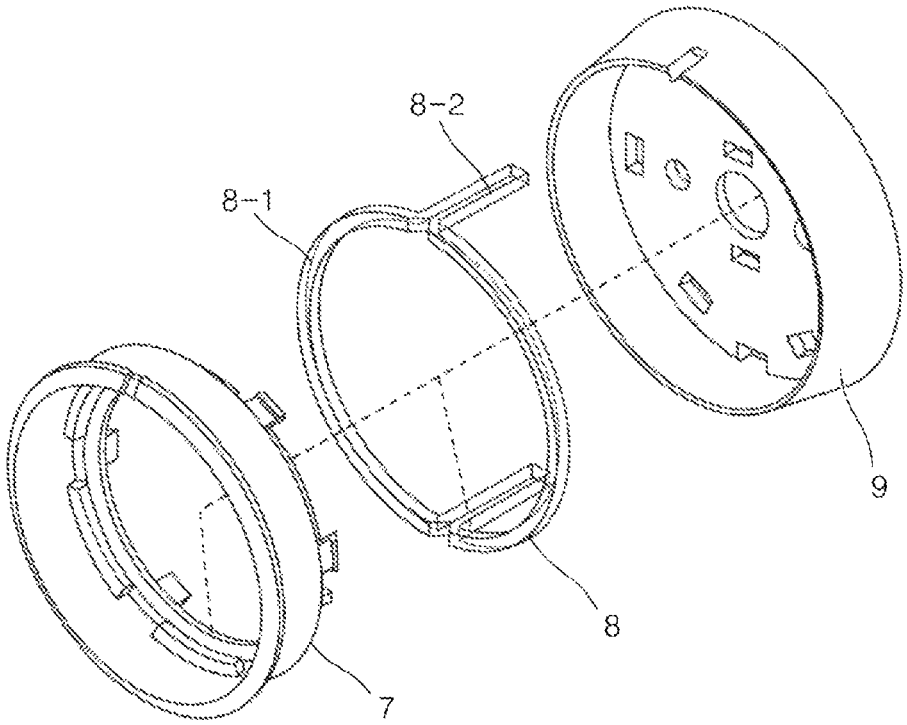
FIG. 3 Prior Art
FIG. 3 is a view showing a portion of a knob assembly in prior art document 2.

The above-described aspects, features and advantages are specifically described hereunder with reference to the accompanying drawings such that one having ordinary skill in the art to which the present disclosure pertains can easily implement the technical spirit of the disclosure. In the disclosure, detailed description of known technologies in relation to the disclosure is omitted if it is deemed to make the gist of the disclosure unnecessarily vague. Below, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

When one component is described as being "in an upper portion (or a lower portion)" of another component, or "on (or under)" another component, one component can be disposed on the upper surface (or under the lower surface) of another component, and an additional component can be interposed between another component and one component on (or under) another component.

When one component is described as being "connected", "coupled", or "connected" to another component, one component can be directly connected, coupled or connected to another component. However, it is also to be understood that an additional component can be "interposed" between the two components, or the two components can be "connected", "coupled", or "connected" through an additional component.

Throughout the disclosure, each component can be provided as a single one or a plurality of ones, unless explicitly stated to the contrary.

The singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the terms "A and/or B" as used herein can denote A, B or A and B, and the terms "C to D" can denote C or greater and D or less, unless stated to the contrary.

Hereunder, a cooktop and a knob assembly thereof in several embodiments are described.

Figure 4:
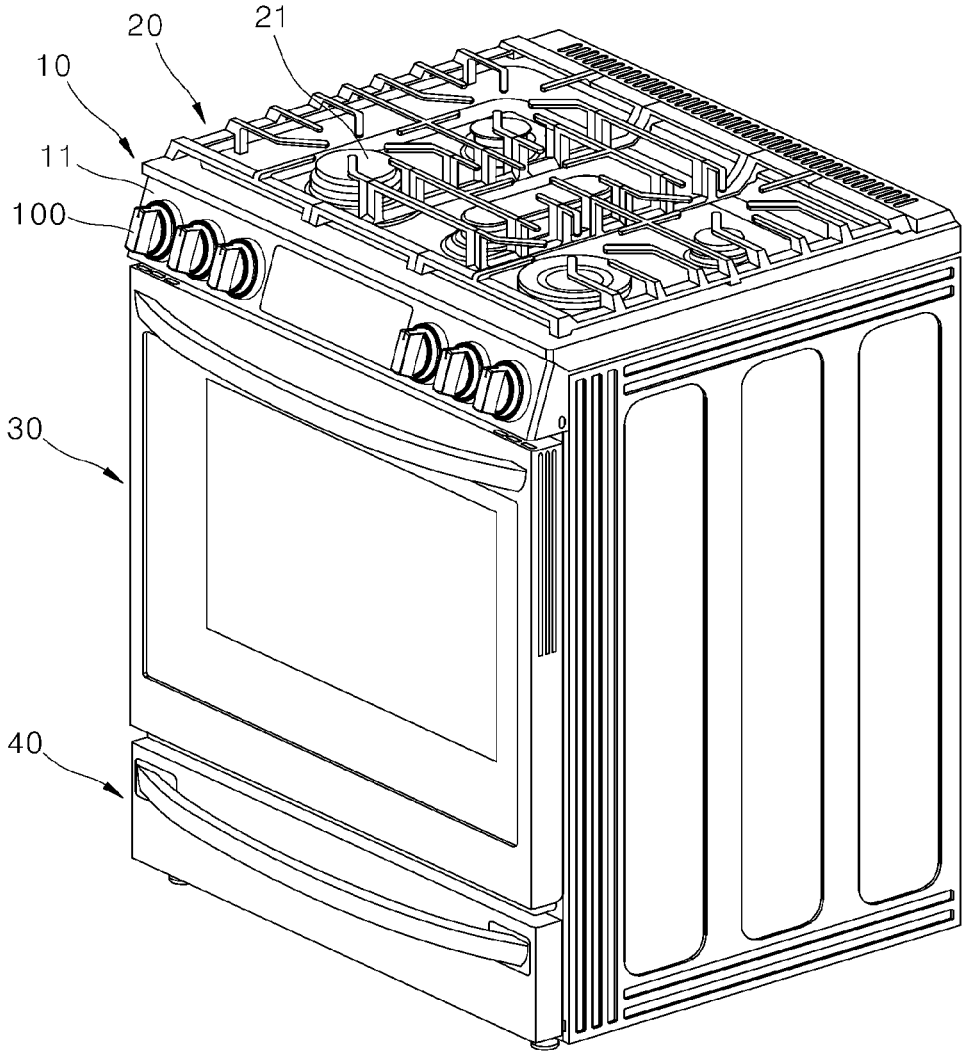
FIG. 4 is a view showing a cooktop provided with a knob assembly in one embodiment.

FIG. 4 is a view showing a cooktop provided with a knob assembly in one embodiment. The cooktop may include a manipulating part 10 and a heating part, and the heating part may include a cooktop part 20, an oven part 30 and a drawer 40.

Components for manipulating operation of the cooktop may be disposed at the manipulating part 10. For example, a knob assembly 100 may be disposed at the manipulating part 10, and the knob assembly 100 may rotate around a rotation shaft that extends in a front-rear direction to adjust a thermal power generated by each part (e.g., the cooktop part 20, the oven part 30 and the drawer 40) of the cooktop or to set an operation mode of each part of the cooktop. The knob assembly 100 may be fixed to a control panel 11 of the manipulating part 10.

The cooktop part 20 may be disposed in an upper portion of the cooktop. The cooktop part 20 may include at least one of cooktop burners 21. The cooktop burner 21 may heat a vessel containing a food item or directly heat a food item to cook the food item using a flame that is produced by burning gases.

The oven part 30 may be disposed in a central portion of the cooktop. The oven part 30 may include a main body forming a cooking space in which a food item is cooked, and a burner assembly for cooking a food item accommodated in the cooking space. Additionally, the oven part 30 may include a door for opening and closing the cooking space.

The drawer 40 may slide into the cooktop or may be withdrawn from the cooktop and may keep a vessel containing a food item and the like at a predetermined temperature.

In FIG. 4, the cooktop includes the oven part, the cooktop part and the drawer as a heating part for cooking a food item, for example. However, the cooktop in one embodiment may exclude some of the oven part, the cooktop part and the drawer.

Additionally, FIG. 4 shows a gas oven including the oven part, the cooktop part and the drawer, which are heating parts capable of cooking a food item, as an example of the cooktop. But the subject matter of the present disclosure may be applied to various types of cooktops such as a cooktop that generates heat using electricity rather than gas or an oven and the like. For example, the cooktop part of the cooktop according to the disclosure may include an induction heater capable of inductively heat a vessel and/or an electric heater capable of generating heat using electricity.

Hereunder, the front denotes a front-surface direction of the cooktop, and the rear denotes a rear-surface direction of the coking appliance, in the disclosure.

Figure 5:
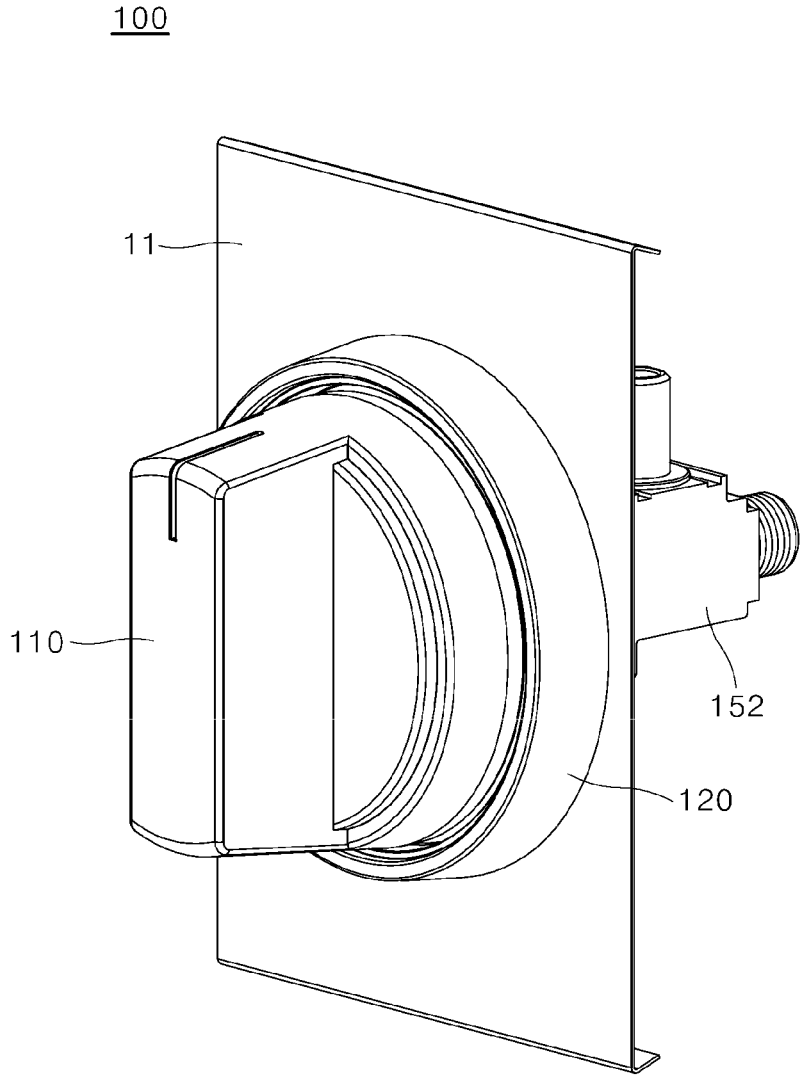
FIG. 5 is a perspective view showing the knob assembly in one embodiment.
Figure 6:
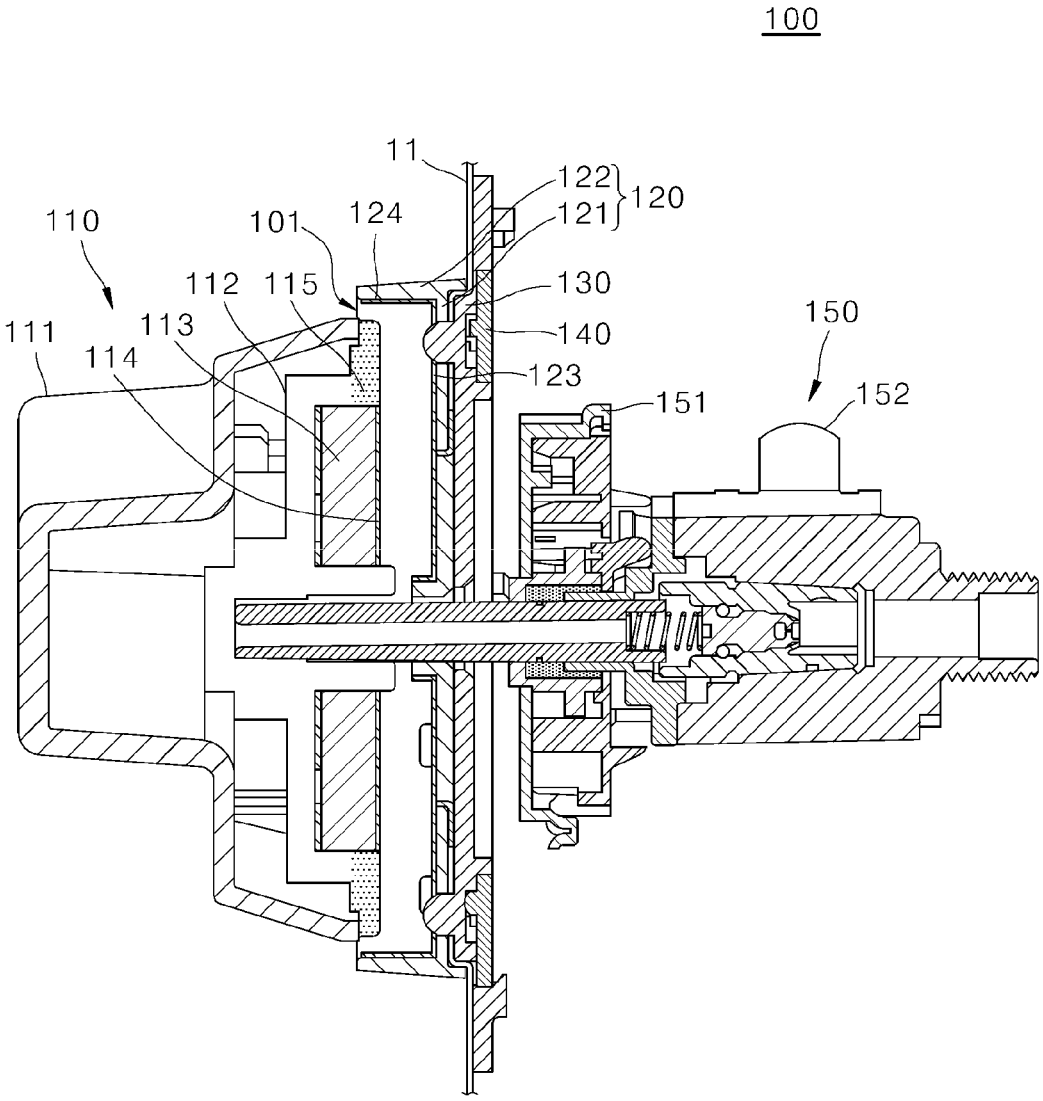
FIG. 6 is a cross-sectional view showing the knob assembly in one embodiment of FIG. 5.
Figure 7:
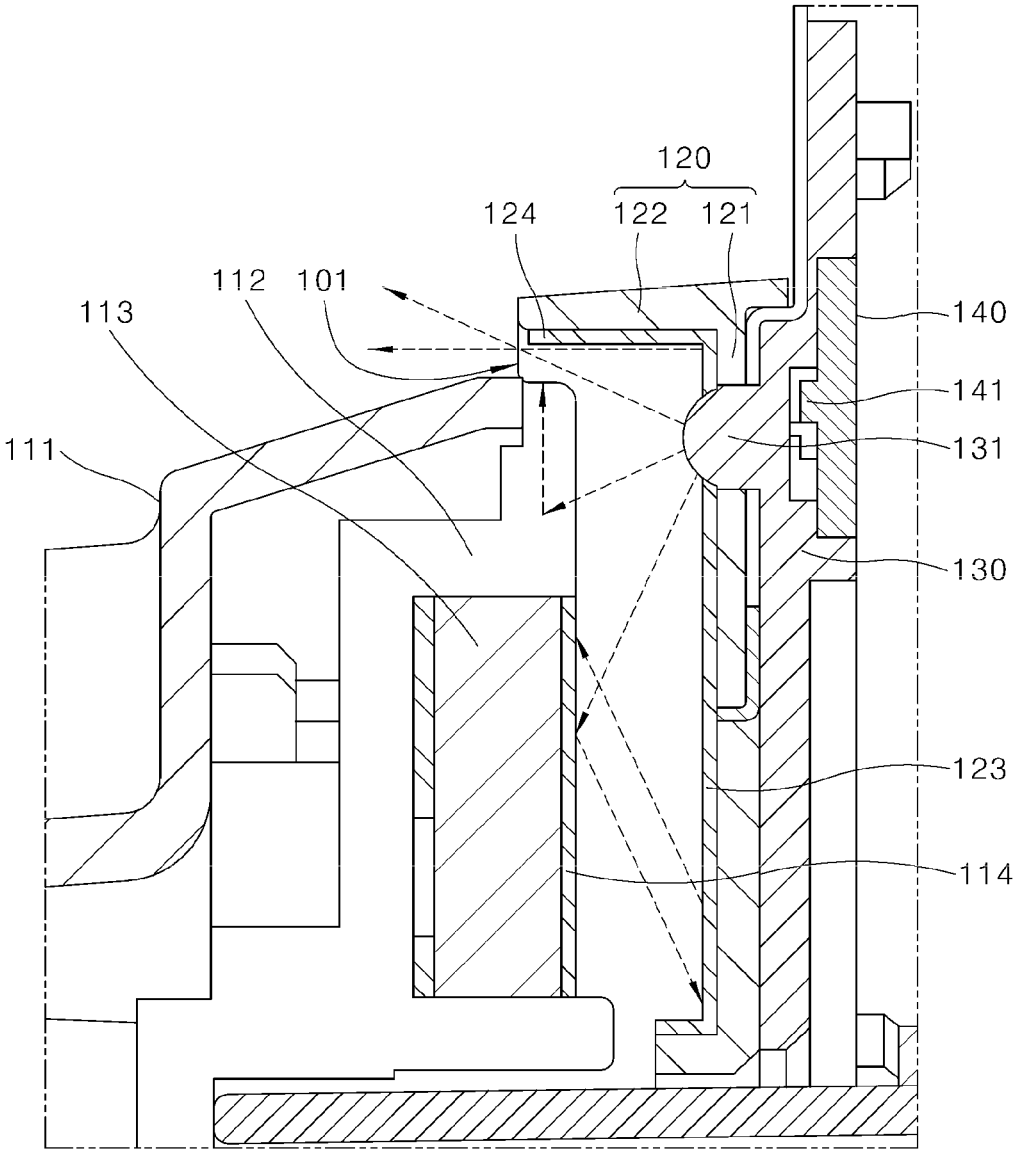
FIG. 7 is a view for describing the proceeding of light in the knob assembly in one embodiment.
Figure 8:
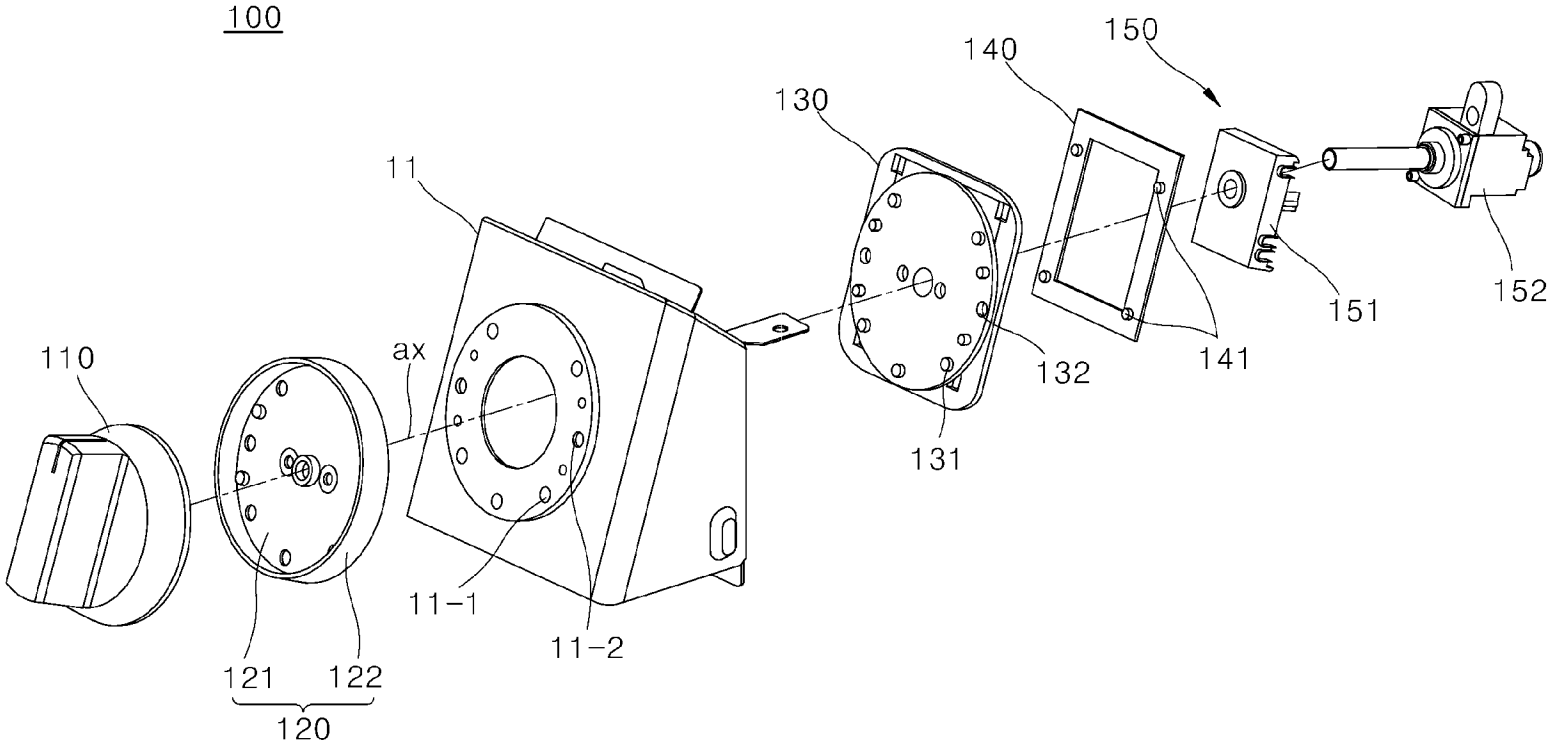
FIG. 8 is an exploded perspective view showing the knob assembly in one embodiment of FIG. 5.

FIG. 5 is a perspective view showing the knob assembly in one embodiment, FIG. 6 is a cross-sectional view showing the knob assembly in one embodiment of FIG. 5, FIG. 7 is a view for describing the proceeding of light in the knob assembly in one embodiment, and FIG. 8 is an exploded perspective view showing the knob assembly in one embodiment of FIG. 5.

The knob assembly 100 in one embodiment may include a knob body 110, a knob ring 120, a supporter 130, a light source part 140, and an adjusting part 150. The adjusting part 150 may include an ignition switch 151 and a valve 152.

The knob body 110 may form an exterior of a front surface of the knob assembly 100. The knob body 110 may be formed into a single component based on integration, or may be comprised of a plurality of components based on coupling. The knob body 110 may rotate around a rotation shaft ax that extends in the front-rear direction. That is, the knob body 110 may be rotatably coupled to the knob ring 120, the supporter 130, the light source part 140 and the adjusting part 150.

The knob body 110 may be provided with a reflective surface capable of reflecting light, in at least a portion of a rear surface thereof. Additionally, the knob body 110 may include a light diffusing part capable of diffusing light. Specifically, the knob body 110 may include a knob 111, a knob inner 112, and an insert 113. The insert 113 may be provided with a first reflective surface 114 capable of reflecting light, in at least a portion of a rear surface thereof. Further, at least a portion of the knob inner 112 may be formed in to a light diffusing part 115 capable of diffusing light. In FIG. 6, a portion of the knob inner 112, which is disposed on an edge of the insert 113 and faces the knob ring 120, is formed into the light diffusing part 115, for example. However, the knob inner 112 may be made of a material that diffuses light in the entire knob inner 12. Below, the configuration of the knob body 110 is described in detail with reference to FIG. 9.

The knob ring 120 may be disposed at a rear of the knob body 110 and may form an exterior of the knob assembly 100. The knob ring 120 may be made of an opaque material and fixed to the control panel 11. Additionally, the knob ring 120 may protect the supporter 130.

The knob ring 120 may be short entirely and formed into a cylinder having a front surface that is completely open. The knob ring 120 may include a plate 121 formed into a flat plate, and a ring 122 surrounding an outer edge of the plate 121 and protruding forward from the plate 121. The ring 122 may have a diameter greater than a diameter of the knob body 110. Additionally, the plate 121 may be provided with an opening through which light passes.

The knob body 110 may be inserted into a space formed by the plate 121 and the ring 122. In this case, the knob body 110 may be slightly spaced from the ring 122.

A second reflective surface capable of reflecting light may be formed in at least a portion of surfaces (i.e., a front surface of the plate 121 and an inner surface of the ring 122) of the knob ring 120, on which the knob body 110 is disposed. Specifically, the second reflective surface may include a 2-1 reflective surface 123 formed in at least a portion of the front surface of the plate 121, and a 2-2 reflective surface 124 formed in at least a portion of the inner surface of the ring 122. The 2-1 reflective surface 123 and/or the 2-2 reflective surface 124 may be formed in a way that a portion of the surfaces of the knob ring 120, which face the knob body 110, is plated or coated. Since the knob ring 120 (specifically, the 2-1 reflective surface 123 and the 2-2 reflective surface 124) reflects light, brightness of light emitted from the knob assembly 100 may become higher, thereby improving visibility.

The supporter 130 may be disposed at a rear of the knob ring 120. The supporter 130 may fix and protect the light source part 140.

A convex part 141 may be formed on a front surface of a portion of the supporter 130, in which a light source 141 of the light source part 140 is disposed, in a way that the convex part 131 protrudes from a surface of the supporter 130. Additionally, a coupling hole 132 for a coupling with the control panel 11 and the knob ring 120 may be formed on the supporter 130.

The light source part 140 may be disposed at a rear of the knob ring 120. The light source part 140 may include at least one of light sources 141 configured to irradiate light toward the rear surface of the knob body 110. The light source 141 may be a light-emitting diode.

The light source part 140 may be fixed to the supporter 130 disposed at the rear of the knob ring 120.

The adjusting part 150 may adjust thermal power output from the cooktop, or adjust operation of the cooktop such as a mode of the cooktop and the like, as a result of rotation of the knob body 110. When the cooktop uses gas as a heat source, the adjusting part 150 may include an ignition switch 151 or a valve 152.

The ignition switch 151 may receive torque of the knob body 110. An on/off state of the ignition switch 151 may change based on a rotation angle of the knob body 110. The ignition switch 151 may be turned on and produce a spark on a fire mouth of a burner (21 in FIG. 4) when the knob body 110 makes a rotation of a predetermined angle.

The valve 152 may receive torque from the knob body 110. An opening degree of the valve 152 may be determined based on a rotation degree of the knob body 110. In some cases, the valve 152 may receive torque from the knob body 110 only when the knob body 110 rotates in a state of being pressed.

The ignition switch 151 and the valve 152 may receive torque of the knob body 110 through a valve shaft.

The control panel 11 may be disposed between the knob ring 120 and the supporter 130. The knob ring 120 and/or the supporter 130 may be coupled to the control panel 11. The control panel 11 may be a portion (e.g., a front surface of the cooktop part 10 in FIG. 4) of the cooktop or a portion of the knob assembly 100. The control panel 11 may have an opening 11-1 through which light of the light source part 140 passes. The convex part 131 of the supporter 130 may be disposed to pass through the opening 11-1. Additionally, the control panel 11 may have at least one of panel holes 11-2 through which the knob ring 120 and/or the supporter 130 are coupled to the control panel 11.

A path in which light proceeds in the knob assembly in one embodiment is described with reference to FIGS. 6 and 7. In FIG. 7, dashed arrows indicate directions in which light proceeds.

As described above, the light source part 140 may be fixed to the supporter 130, and the convex part 131 may formed on a front surface of the supporter 130, corresponding to the position of the light source 141. The knob ring 120 may have an opening, and the convex part 131 may pass through the opening.

Light irradiated from the light source 141 of the light source part 140 may pass through the convex part 131 of the supporter 130 and proceed to a space between the knob ring 120 and the knob body 110.

Some of the light having passed through the convex part 131 may proceed to a gap between the knob 111 and the knob ring 120, and a user may recognize the light.

Some of the light having passed through the convex part 131 may be scatted and reflected by the first reflective surface 114 formed on the insert 113 and the second reflective surface (i.e. the 2-1 reflective surface 123 and the 2-2 reflective surface 124) formed on the knob ring 120, and some of the light scattered and reflected may proceed to the gap 101 between the knob 111 and the knob ring 120 such that the user recognizes the light.

Some of the light having passed through the convex part 131 and some of the light scattered and reflected may diffuse in the knob inner 112, and the diffused light may proceed to the gap 101 between the knob 11 and the knob ring 120 through an outer end of the knob inner 112 such that the user recognizes the light. As described above, the knob inner 112 may be entirely made of a material capable of diffusing light, or a portion 115 of the knob inner 112 may be made of a material capable of diffusing light. When a portion 115 of the knob inner 112 is made of a material capable of diffusing light, the knob inner 112 may be implemented in a way that two components are assembled.

That is, in one embodiment, the light reflected by the first reflective surface 114 formed on the insert 113 and by the second reflective surface (i.e., the 2-1 reflective surface 123 and the 2-2 reflective surface 124) formed on the knob ring 120 may proceed to the gap 101 between the knob 111 and the knob ring 120 while the light irradiated from the light source 141 may directly proceed to the gap 101 between the knob 111 and the knob ring 120. Further, the light diffused in the knob inner 112 may also proceed to the gap 101 between the knob 111 and the knob ring 120. As a result, an amount of the light proceeding to the gap 101 between the knob 111 and the knob ring 120 may increase, thereby improving visibility. In the structure, light having constant brightness may be emitted entirely from the gap 101, thereby ensuring improvement in aesthetic qualities.

Figure 9:
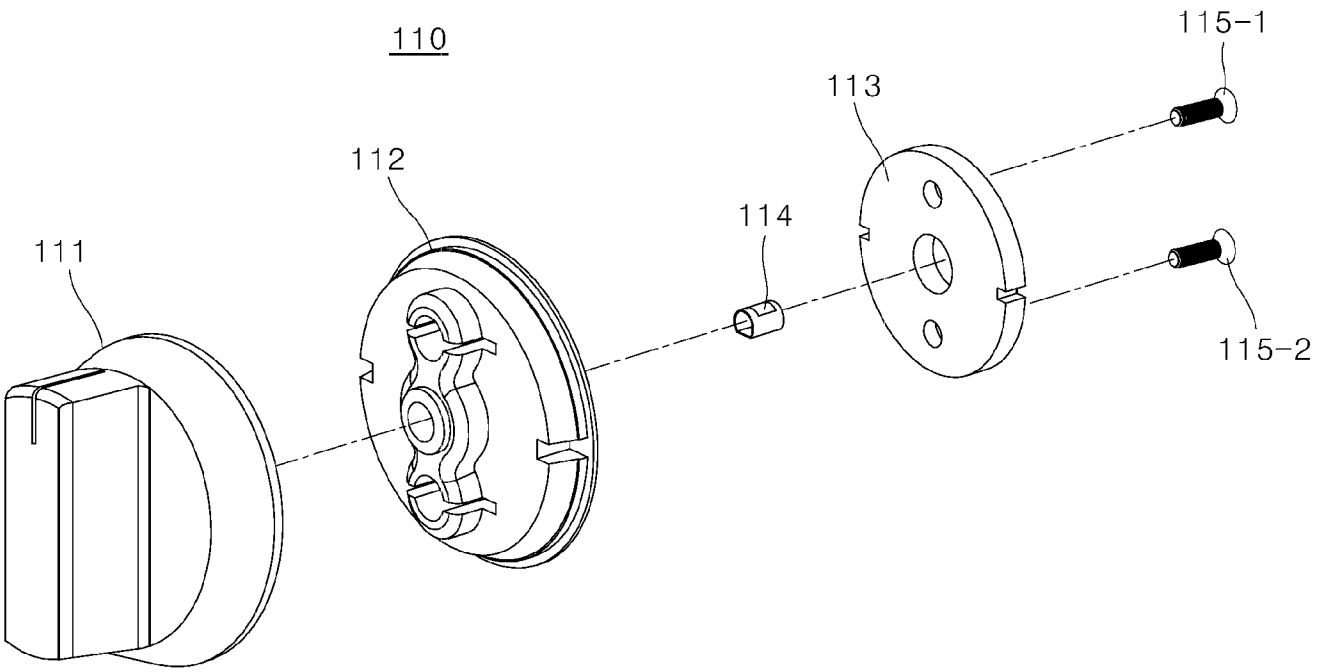
FIG. 9 is an exploded perspective view showing an example of a knob body of the knob assembly in one embodiment.

FIG. 9 is an exploded perspective view schematically showing an example of a knob body 110 of the knob assembly 100 in one embodiment. The knob body 110 may include a knob 111, a knob inner 112, an insert 113, a spring 114, and screw bolts 115-1, 115-2.

The knob 111 may form an exterior of a front surface of the knob assembly 100. The knob 111 may have a cylindrical body and a handle protruding from a front surface of the body. The knob 111 may have a rear surface that is open, and an inner space may be formed inside the open surface. The knob 111 may be formed as a result of injection molding.

The knob inner 112 may be inserted into the inner space of the knob 111 through the rear surface of the knob 111. The knob inner 112 may have a rear surface that is open, and an inner space may be formed inside the open surface. In this case, the open surface may be a central portion of the knob inner 112. That is, when viewed from the rear, the knob inner 112 may have the inner space in the central portion thereof. Additionally, the knob inner 112 may be made of a material capable of diffusing light. For example, the knob inner 112 may be made of an opaque plastic material. That is, in one embodiment, the knob inner 112 capable of diffusing light may be disposed between the knob 111 and the light source part 140. The diffused light, and the light directly emitted from the light source part 140 may be diffused by the knob inner 112 out of the knob assembly, thereby improving visibility.

The insert 113 may be inserted into the inner space of the knob inner 112 through the rear surface of the knob inner 112. The insert 113 may be made of a material such as metal, and may be inserted into the knob 111 along with the knob inner 112, thereby improving rigidity and preventing deformation of the knob 111.

At least a portion of the rear surface of the insert 113 may reflect light. To this end, at least a portion of the rear surface of the insert 113 may be plated or coated.

The spring 114 may be disposed in the knob body 110 and may connect between the knob 111 and the valve shaft.

The screw bolts 115-1, 115-2 may fix the knob inner 112 and the insert 113 to the knob 111.

Figure 10:
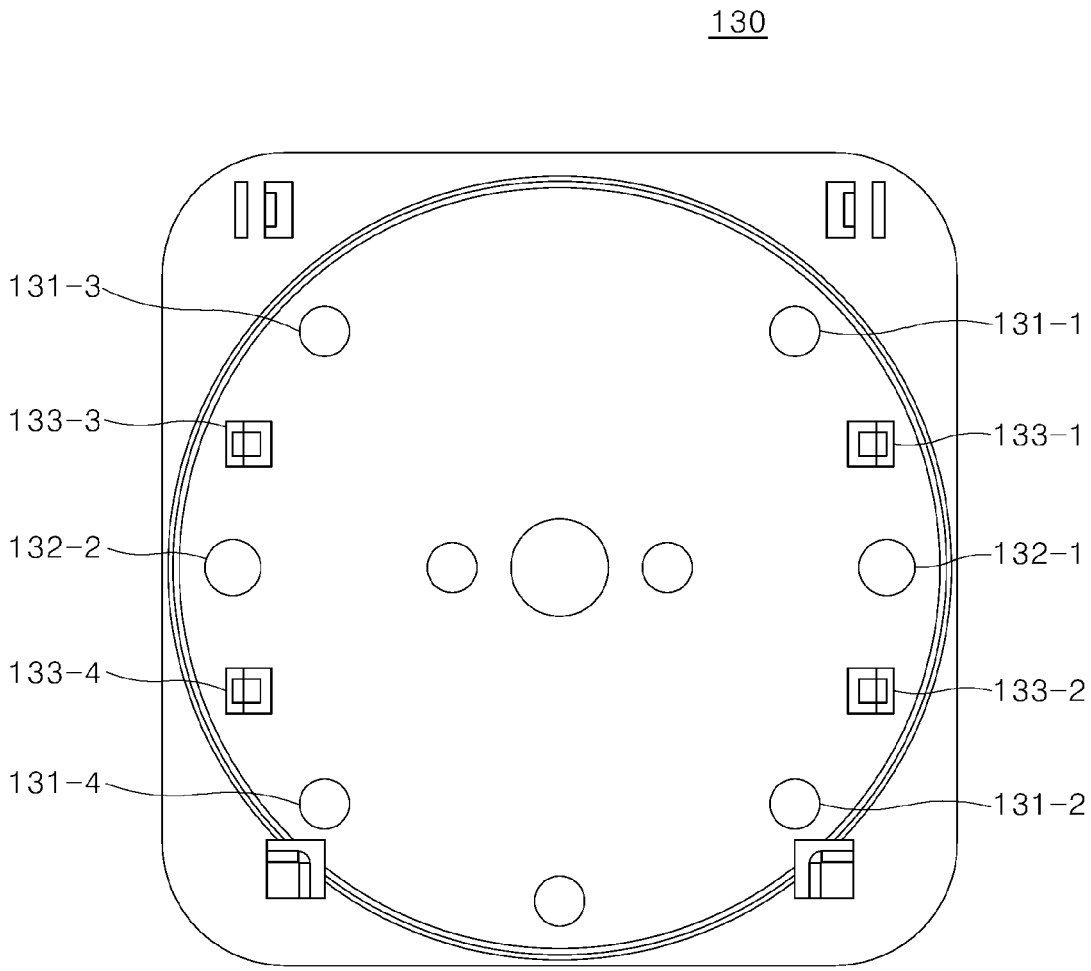
FIG. 10 is a view showing a supporter of the knob assembly in one embodiment, when viewed from the front.
Figure 11:
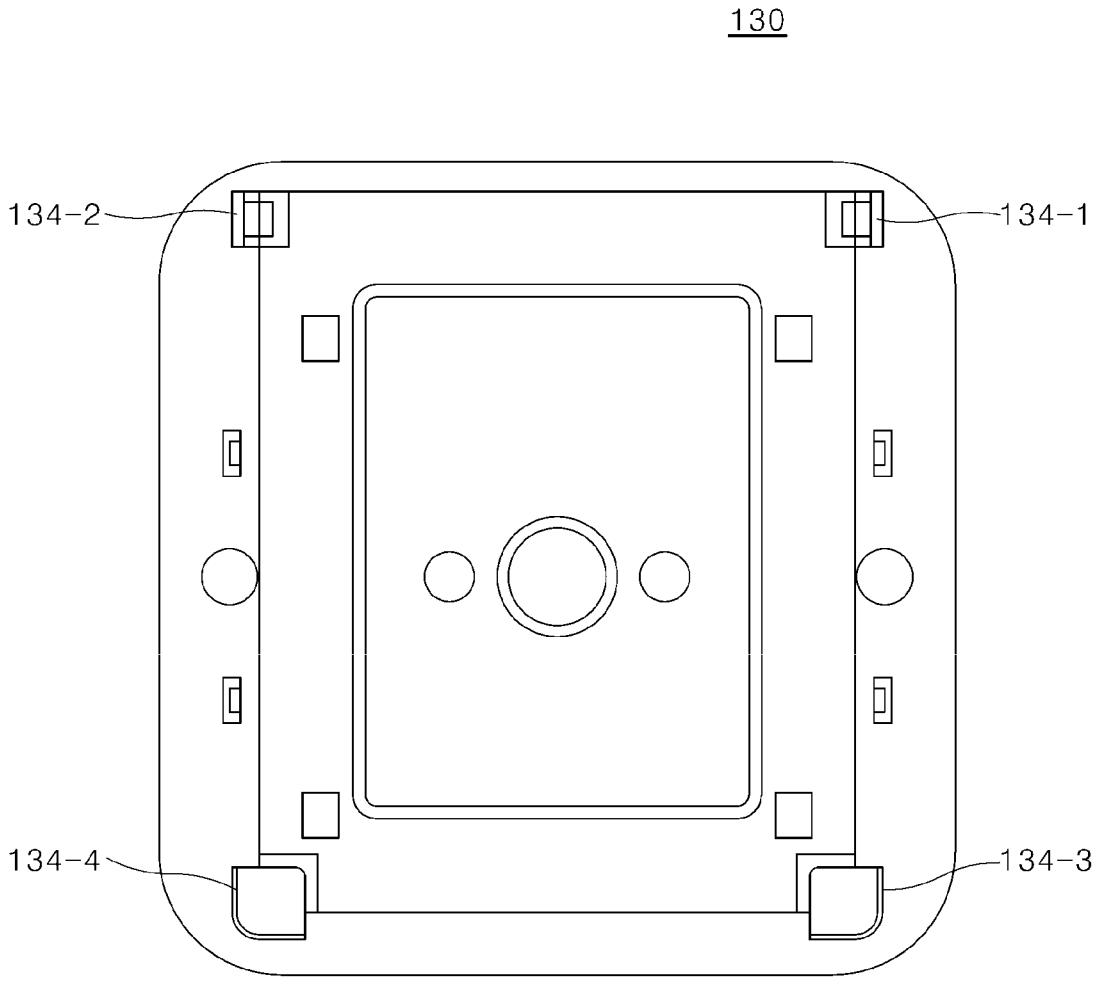
FIG. 11 is a view showing the supporter of the knob assembly in one embodiment, when viewed from the rear.

FIG. 10 is a view showing a supporter 130 of the knob assembly 100 in one embodiment, when viewed from the front, and FIG. 11 is a view showing the supporter 130 of the knob assembly 100 in one embodiment, when viewed from the rear.

The supporter 130 may fix and protect the light source part 140. The supporter 130 may be made of a material capable of transmitting and/or diffusing light. For example, the supporter 130 may be made of an opaque plastic.

Referring to FIG. 10, the supporter 130 may include a plurality of convex parts 131-1, 131-2, 131-3, 131-4 that is formed on the front surface of the supporter 130. The plurality of convex parts 131-1, 131-2, 131-3, 131-4 may be formed at a position corresponding to the position of the light source 141 of the light source part 140. The convex part may be formed on a front surface of a position where the light source 141 of the light source part 140 is disposed when the light source part 140 is fixed to a rear surface of the supporter 130. The convex parts 131-1, 131-2, 131-3, 131-4 may perform a function similar to the function of a lens.

Additionally, the supporter 130 may have at least one of first coupling holes 132-1, 132-2 for a coupling with the control panel 11 and/or the knob ring 120. As a result of insertion of a bolt and the like into the first coupling holes 132-1, 132-2, the supporter 130 may be coupled to the control panel 11 and/or the knob ring 120.

Further, the supporter 130 may have at least one of second coupling holes 133-1, 133-2, 133-3, 133-4 for a coupling with the knob ring 120. Though not illustrated, the knob ring 120 may have at least one of coupling hooks, on a rear surface thereof, and the coupling hooks and the second coupling holes may be fitted-coupled to one another.

Referring to FIG. 11, light source fixing parts 134-1, 134-2, 134-3, 134-4 may be disposed on the rear surface of the supporter 130. Each of the first light source fixing part 134-1 and the second light source fixing part 134-2 may push a rear surface of the light source part 140 forward while guiding the light source part 140 on one side to fix the light source part 140. Each of the third light source fixing part 134-3 and the fourth light source fixing part 134-4 may push the rear surface of the light source part 140 forward while supporting an edge portion of the light source part 140 in two directions to fix the light source part.

Figure 12:
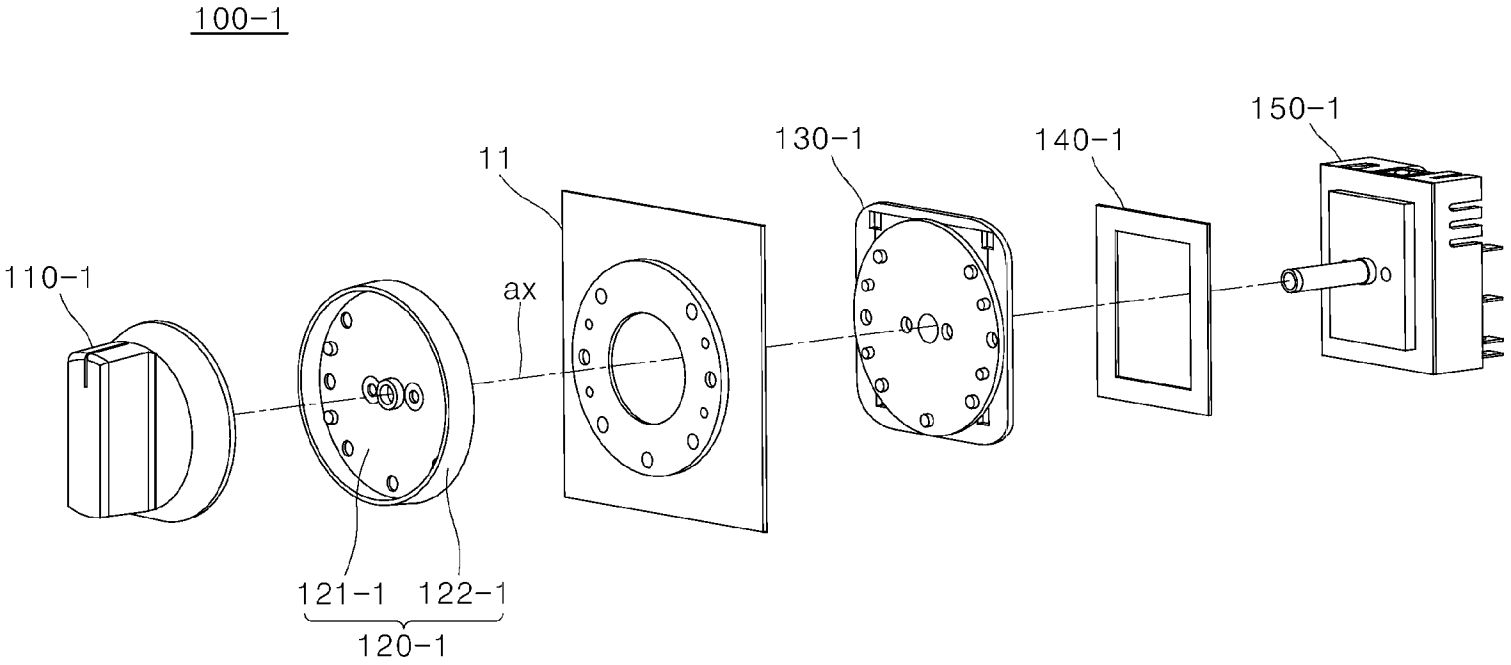
FIG. 12 is an exploded perspective view showing a knob assembly in another embodiment.

FIG. 12 is an exploded perspective view showing a knob assembly 100-1 in another embodiment. The knob assembly 100-1 may include a knob body 110-1, a knob ring 120-1, a supporter 130-1, a light source part 140-1, and an adjusting part 150-1. The knob ring 120-1 may include a plate 121-1 and a ring 122-1. The adjusting part 150-1 may be a rotary switch. In FIG. 12, reference numeral 11 indicates a control panel.

The knob body 110-1, the knob ring 120-1, the supporter 130-1 and the light source part 140-1 may be respectively the same as the knob body 110, the knob ring 120, the supporter 130 and the light source part 140 described with reference to FIGS. 7 to 11. The adjusting part 150-1 may perform a function the same as that of the adjusting part 150 described with reference to FIG. 7.

That is, the knob assembly 100-1 in FIG. 12 is the same as the knob assembly 100 in FIG. 7 and the like except that the adjusting part 150-1 is a rotary switch. When the cooktop inductively heats a vessel or adopts an electric heater and the like using electricity to generate heat, a rotary switch may be applied instead of the adjusting part comprised of the ignition switch and the valve.

The embodiments are described above with reference to a number of illustrative embodiments thereof. However, the present disclosure is not intended to limit the embodiments and drawings set forth herein, and numerous other modifications and embodiments can be devised by one skilled in the art without departing from the technical spirit of the disclosure. Further, the effects and predictable effects based on the configurations in the disclosure are to be included within the range of the disclosure though not explicitly described in the description of the embodiments.

The invention claimed is:

1. A cooktop, comprising:

a manipulating part comprising (i) a control panel and (ii) a knob assembly that is coupled to the control panel, wherein the knob assembly includes:

a knob body that is disposed at a front surface of the control panel and that is configured to rotate with respect to the control panel, a knob ring that is disposed at a rear side of the knob body and that has a diameter greater than a diameter of the knob body, and a light source part that is disposed at the rear side of the knob body and that includes one or more light sources configured to irradiate light to the rear side of the knob body, wherein a portion of a rear surface of the knob body includes a first reflective surface configured to reflect light, wherein a portion of a surface of the knob ring includes a second reflective surface configured to reflect light, the portion of the surface of the knob ring facing the knob body, and wherein the knob body further comprises:

a knob that defines an exterior of a front surface of the knob assembly and that defines an opening at a rear side defining a first inner space, and a knob inner member that is inserted into the first inner space, a portion of the knob inner member providing a light diffusing part configured to diffuse light.

2. The cooktop of claim 1, wherein the knob ring further comprises:

a plate; and a ring that surrounds an outer edge of the plate, that protrudes from the plate, that has a diameter greater than the diameter of the knob body, and that defines an exterior of the knob assembly, wherein the second reflective surface comprises (i) a third reflective surface defined at a portion of a front surface of the plate and (ii) a fourth reflective surface defined at a portion of an inner surface of the ring.

3. The cooktop of claim 2, wherein a portion of the knob body is inserted into a space defined by the plate and the ring.

4. The cooktop of claim 1, wherein the knob body further comprises:

an insert member that is inserted into a second inner space defined at a rear side of the knob inner member.

5. The cooktop of claim 4, wherein the insert member includes the first reflective surface at a rear surface.

6. The cooktop of claim 4, wherein the insert member faces a central portion of the knob inner member.

7. The cooktop of claim 1, wherein:

the knob ring defines one or more openings, the light source part is disposed at a rear side of the knob ring, and at least one of the one or more light sources is disposed at a rear side of the one or more openings of the knob ring.

8. The cooktop of claim 7, further comprising:

a supporter that is disposed between the knob ring and the light source part and that includes the light source part coupled to a rear surface of the supporter, wherein the supporter comprises one or more convex parts that protrude forward from a front surface facing one of the one or more light sources and that pass through the one or more openings.

9. A knob assembly, comprising:

a knob body rotatably disposed on a front side of a control panel;

a knob ring that is disposed at a rear side of the knob body, that has a diameter greater than a diameter of the knob body, and that is coupled to the control panel; and a light source part that is disposed at the rear side of the knob body and that includes one or more light sources configured to irradiate light to the rear side of the knob body, wherein a portion of a rear surface of the knob body includes a first reflective surface configured to reflect light, and wherein a portion of a surface of the knob ring includes a second reflective surface configured to reflect light, the portion of the surface of the knob ring facing the knob body, wherein the knob body further comprises:

a knob that defines an exterior of a front surface of the knob assembly and that defines an opening at a rear surface side defining a first inner space, a knob inner member that is inserted into the first inner space to be coupled to the knob, a portion of the knob inner member providing a light diffusing part configured to diffuse light.

10. The knob assembly of claim 9, wherein the knob ring further comprises:

a plate; and a ring that surrounds an outer edge of the plate, that protrudes from the plate, that has a diameter greater than the diameter of the knob body, and that defines an exterior of the knob assembly, wherein the second reflective surface comprises (i) a third reflective surface defined at a portion of a front surface of the plate and (ii) a fourth reflective surface defined at a portion of an inner surface of the ring.

11. The knob assembly of claim 10, wherein a portion of the knob body is inserted into a space defined by the plate and the ring.

12. The knob assembly of claim 9, wherein the knob body further comprises:

an insert member that is inserted into a second inner space defined at a rear side of the knob inner member.

13. The knob assembly of claim 12, wherein the insert member includes the first reflective surface at a rear surface.

14. The knob assembly of claim 12, wherein the insert member faces a central portion of the knob inner member.

15. The knob assembly of claim 9, further comprising:

a supporter that is disposed between the knob ring and the light source part, that includes the light source part coupled to a rear surface of the supporter, and that includes a convex part protruding forward from a front surface of a position corresponding to a position of one of the one or more light sources, wherein the knob ring defines one or more openings, and wherein the convex part passes through the one or more openings.

* * * * *